US010310528B1

(12) United States Patent
Elsayed et al.

(10) Patent No.: US 10,310,528 B1
(45) Date of Patent: Jun. 4, 2019

(54) SYSTEM AND METHOD FOR CORRECTING OFFSET VOLTAGE ERRORS WITHIN A BAND GAP CIRCUIT

(71) Applicant: Silicon Laboratories Inc., Austin, TX (US)

(72) Inventors: Mohamed Elsayed, Austin, TX (US); Scott D. Willingham, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 15/833,515

(22) Filed: Dec. 6, 2017

(51) Int. Cl.

| | |
|---|---|
| ***G05F 1/565*** | (2006.01) |
| ***G05F 1/46*** | (2006.01) |
| ***G05F 1/575*** | (2006.01) |
| ***G05F 3/22*** | (2006.01) |
| ***G05F 3/24*** | (2006.01) |
| ***G05F 3/30*** | (2006.01) |

(52) U.S. Cl.
CPC ..... *G05F 1/575* (2013.01); *G05F 1/565* (2013.01)

(58) Field of Classification Search
CPC ..... G05F 1/565; G05F 1/461; G05F 1/463; G05F 1/575; G05F 3/22; G05F 3/222; G05F 3/242; G05F 3/30
See application file for complete search history.

(56) References Cited

U.S. PATENT DOCUMENTS

| | | | | |
|---|---|---|---|---|
| 3,271,660 | A | 9/1966 | Hilbiber | |
| 4,249,122 | A | 2/1981 | Widlar | |
| 4,447,784 | A | 5/1984 | Dobkin | |
| 6,329,804 | B1 * | 12/2001 | Mercer | G05F 3/30 323/314 |
| 6,501,256 | B1 * | 12/2002 | Jaussi | G05F 3/30 323/315 |
| 6,933,770 | B1 * | 8/2005 | Ranucci | G05F 3/30 257/E27.029 |
| 8,791,683 | B1 * | 7/2014 | Porter | G05F 3/30 323/281 |
| 9,141,124 | B1 * | 9/2015 | Nien | G05F 3/30 |
| 9,354,644 | B2 * | 5/2016 | Sharma | H03F 3/45771 |

(Continued)

OTHER PUBLICATIONS

"Op Amp Input Offset Voltage" Analog Devices. MT-037 Tutorial. Rev.0 Oct. 2008. pp. 1-10.

*Primary Examiner* — Timothy J. Dole
*Assistant Examiner* — Sisay G Tiku
(74) *Attorney, Agent, or Firm* — Gary Stanford

(57) ABSTRACT

A band gap circuit with offset voltage error correction including a diode junction circuit, an error amplifier, a current device, a bias current generator, a calibration circuit, and a mode control circuit. During a normal mode of operation, the error amplifier monitors feedback nodes of the diode junction circuit and drives the current device to provide a control current to the diode junction circuit. During a calibration mode, the current device is decoupled from the diode junction circuit and the inputs of the error amplifier are shorted together, the bias generator circuit sinks a bias current from the current device and separately sources a bias current to the diode junction circuit such that the error amplifier operates as a comparator, and the calibration circuit monitors the output of the current device while adjusting a trim current of the error amplifier to minimize an offset voltage error of the error amplifier.

20 Claims, 6 Drawing Sheets

(56) References Cited

U.S. PATENT DOCUMENTS

| | | | | |
|---|---|---|---|---|
| 9,671,800 | B2 * | 6/2017 | Cave | G05F 1/468 |
| 2002/0176198 | A1 * | 11/2002 | Cyrusian | G11B 20/10009 360/68 |
| 2011/0102058 | A1 * | 5/2011 | Conte | G05F 3/30 327/512 |
| 2011/0248688 | A1 * | 10/2011 | Iacob | G05F 1/575 323/234 |
| 2016/0266598 | A1 * | 9/2016 | Wong | G05F 3/30 |

* cited by examiner

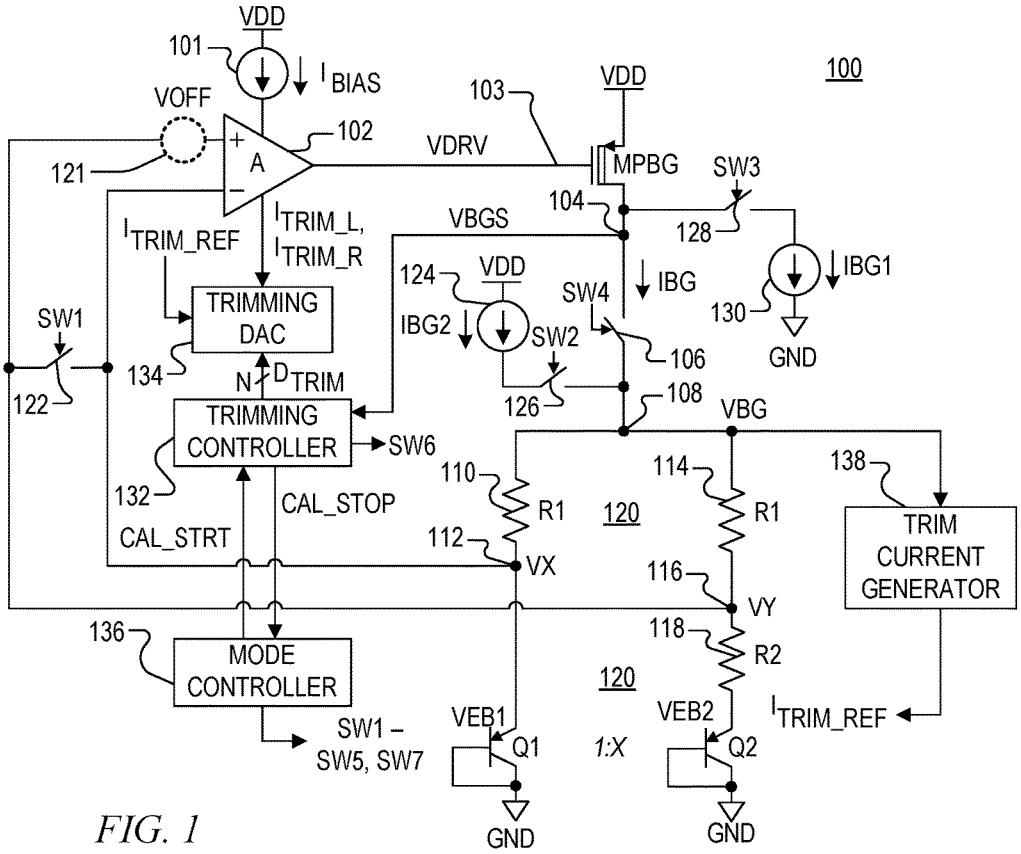
*FIG. 1*
*FIG. 2*
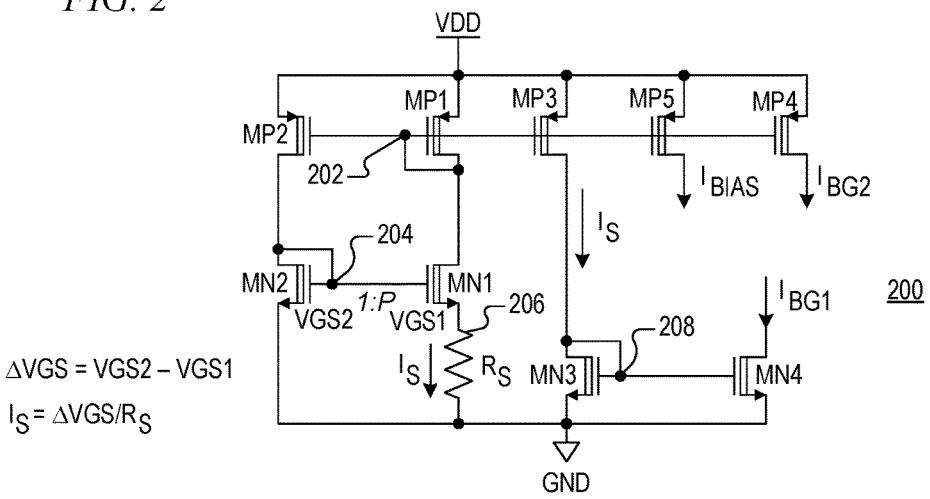

SYSTEM AND METHOD FOR CORRECTING OFFSET VOLTAGE ERRORS WITHIN A BAND GAP CIRCUIT

BACKGROUND OF THE INVENTION

Field of the Invention

The present invention relates in general to error amplifier offset correction, and more particularly to a system and method for correcting an offset voltage error of an error amplifier used within a band gap circuit that provides a band gap voltage.

Description of the Related Art

A band gap circuit provides a fixed band gap voltage that is relatively independent of one or more circuit variables, including, for example, temperature changes, power supply voltage changes, and manufacturing process variables. The band gap voltage is typically used by various devices in the circuit, such as regulators and converters (analog to digital or vice-versa) and the like, so that accuracy of the band gap voltage is often critical to proper circuit operation and/or maximum performance. The band gap circuit may include an error amplifier in a closed loop configuration that establishes or maintains at least one circuit control parameter to eliminate or otherwise minimize band gap voltage variations. The error amplifier, however, may have an input referred offset voltage error which, if not corrected, reduces the accuracy of the band gap voltage.

Several conventional correction techniques are known. An auto-zero technique has been used to achieve a modest level of accuracy with the use of reasonable capacitor sizes. The auto-zero technique, however, could only achieve a high level of accuracy with the use of very large capacitors, which resulted in a significant area penalty. An offset-nulling technique required an extra pin on the integrated circuit (IC) to apply a nulling voltage to compensate for the offset voltage error. The offset-nulling technique also did not correct for offset voltage variations over time. A chopping technique generates output glitches that required a large output filter capacitor. High end laser trimming techniques are expensive and only provided a one-time permanent trim that did not correct for offset voltage error variations over time.

SUMMARY OF THE INVENTION

A band gap circuit with offset voltage error correction according to one embodiment includes a diode junction circuit, an error amplifier, a current device, a bias current generator, a calibration circuit, and a mode control circuit. The diode junction circuit includes an input node, a first feedback node, and a second feedback node, in which the diode junction circuit includes proportional and complimentary temperature coefficients when the first and second feedback nodes are driven to a common voltage level. The error amplifier has a positive input coupled to the second feedback node, has a negative input coupled to the first feedback node, has an output, and has at least one trim node. The current device has a control terminal coupled to the output of the error amplifier and has an output that provides a control current during a normal mode. The bias current generator with constant gain sinks a first bias current and sources a second bias current. The calibration circuit monitors the output of the current device while adjusting a trim current provided to the at least one trim node of the error amplifier to minimize an offset voltage error of the error amplifier during a calibration mode. The mode control circuit couples the current device to the input node to provide the control current to the diode junction circuit during the normal mode, and periodically enters the calibration mode during which the mode control circuit decouples the current device from the diode junction circuit, shorts together the positive and negative inputs of the error amplifier, and couples the current generator to sink the first bias current from the output of the current device and to source the second bias current to the input node of the diode junction circuit.

The mode control circuit may control multiple switches for transitioning the band gap circuit between the normal and calibration modes. The bias current generator may include a current mirror circuit that is configured to develop the first and second bias currents to have nominal magnitudes that are equivalent to a nominal magnitude of the control current during the normal mode. The diode junction circuit may include a first resistor coupled between the input node and the first feedback node, a first diode junction coupled between the first feedback node and ground, a second resistor coupled between the input node and the second feedback node, a third resistor having a first terminal coupled to the second feedback node and having a second terminal, and a second diode junction coupled between the second terminal of the third resistor and ground. The bias current generator may be configured to develop a reference current based on a gate-source voltage difference between a pair of MOS transistors divided by a first resistance in which the reference current is mirrored to develop the first and second bias currents, and in which the diode junction circuit develops the control current proportional to a voltage difference between voltages developed across the first and second diode junctions divided by a resistance of the third resistor.

The calibration circuit may include a trimming controller and a trimming digital to analog converter (DAC). The trimming controller monitors the output of the current device while updating a digital trim value during the calibration mode. The trimming DAC converts the digital trim value to the trim current coupled to the at least one trim node of the error amplifier. The trimming controller may update the digital trim value using successive approximation.

The error amplifier may include a first set of transistors stacked between a source voltage and a common node including a first trim node and the positive input, and a second set of transistors stacked between the source voltage and the common node including a second trim node, the negative input and the output. The trimming DAC may adjust the trim current by balancing between a first trim current of the first trim node and a second trim current of the second trim node based on the digital trim value. In one embodiment, the upper transistors of the error amplifier and the current device are PMOS transistors that are each sized to have approximately the same current density. The error amplifier may further include a switch having switched terminals coupled between an upper node coupled to the upper transistors and the output of the error amplifier, in which the switch remains open during the normal mode. Also, the trimming controller may update the digital trim value one bit at a time during the calibration mode, and for each bit being updated, may momentarily close the internal switch of the error amplifier for a reset period to set the output of the error amplifier to a voltage level of the upper node.

The trimming DAC may include one or more arrays of resistors, transistors and switches that develop the first and second trim currents based on a reference trim current and that balances the relative magnitudes of the trim currents based on a state of the transistors and switches. The successive sizes of the transistors and resistors of the arrays of transistors and resistors may be according to a scaling factor of less than two for redundancy.

The band gap circuit may further include a sample and hold circuit that samples a band gap voltage developed by the diode junction circuit during the normal mode and that holds a sample of the band gap voltage during the calibration mode. The sample and hold circuit may include low-temperature coefficient sample resistor and is operative to develop and provide the reference trim current used for developing nominal magnitudes of the first and second trim currents.

A method of correcting offset voltage of a band gap circuit is disclosed, in which the band gap circuit includes an error amplifier having a pair of inputs inputting a pair of feedback nodes of a diode junction circuit for driving a current device having an output that provides a control current to the diode junction circuit during a normal mode of operation. The method may include periodically switching to a calibration mode by decoupling the output of the current device from the diode junction circuit, sinking a first bias current from the current device, sourcing a second bias current to the diode junction circuit, and shorting the inputs of the error amplifier, and trimming the error amplifier during the calibration mode. The trimming may include adjusting at least one bit of a multi-bit digital trim value in which the at least one bit includes a bit under test, converting the digital trim value to a trim current applied to the error amplifier, and determining a state of the bit under test based on a state of the output of the current device.

The method may include repeating the adjusting, converting, and determining for performing a successive approximation algorithm to determine a state of each bit of the digital trim value. The method may include selecting a most significant bit of the digital trim value as the bit under test, setting the bit under test high and setting remaining lower bits to half scale, determining a final state of the bit under test for a current session of the calibration mode based on a state of the output of the current device, selecting the next lower significant bit as the bit under test, and repeating the setting the bit under test high, the determining a final state of the bit under test, and the selecting the next lower significant bit as the bit under test for each remaining bit of the digital trim value. The method may include resetting the error amplifier to mid-rail before determining a final state of the bit under test while determining a state of each bit.

The method may include sinking a first bias current having a magnitude that is equivalent to a nominal magnitude of the control current during the normal mode, and sourcing a second bias current to the diode junction circuit having a magnitude that is equivalent to a nominal magnitude of the control current during the normal mode. The method may include adjusting a balance between first and second trim currents applied to positive and negative trim nodes of the error amplifier.

The method may include developing, by the diode junction circuit, a band gap voltage during the normal mode, sampling the band gap voltage during the normal mode and holding a sample of the band gap voltage on a sample node during the calibration mode and converting the band gap voltage on the sample node to a reference trim current used to develop the first and second trim currents.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

FIG. 1 is a simplified schematic and block diagram of a BG circuit implemented according to one embodiment of the present invention.

FIG. 2 is a schematic diagram of a bias current generator implemented according to one embodiment of the present invention for developing the bias and BG currents of FIG. 1.

DETAILED DESCRIPTION

Figure 3:
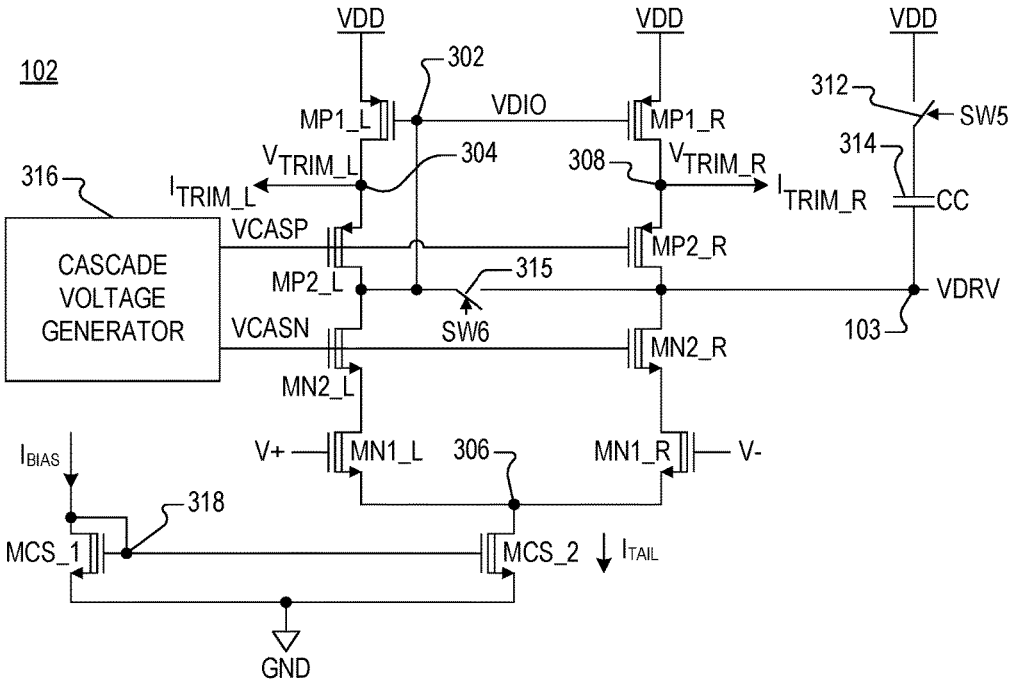
FIG. 3 is a schematic and block diagram of the error amplifier of FIG. 1 implemented according to one embodiment of the present invention.

The inventors have recognized the need to provide a substantially fixed band gap voltage that develops and maintains a high level of accuracy over time. The term "fixed" as used herein is defined as invariable or unchanging in spite of circuit variables, such as temperature changes, power supply voltage changes, and manufacturing process variables. They have therefore developed a system and method for correcting the offset voltage error of an error amplifier used within a band gap (BG) circuit providing the band gap voltage. The BG circuit includes a diode junction circuit, the error amplifier, and a current device, in which the diode junction circuit includes an input node and a pair of feedback nodes. During a normal mode of operation, the error amplifier drives the current device to provide a BG current to the input node to keep the feedback nodes at a common voltage level. In one embodiment, the input node develops the band gap voltage, in which case the diode junction circuit is configured to maintain the input node at the fixed band gap voltage when the control nodes have the same voltage level. In the general case, the diode junction circuit incorporates both positive and negative temperature coefficients that offset so that at least one node in the BG circuit develops the fixed band gap voltage. The BG node may be configured as part of the diode junction circuit or elsewhere in the BG circuit depending upon the particular implementation.

The accuracy of the band gap voltage degrades when the error amplifier develops an offset voltage error during operation which appears as a voltage offset between the feedback nodes. The BG circuit further includes a current generator, a calibration circuit, and a mode switch circuit for switching between the normal mode and a calibration mode used to trim the error amplifier to minimize the offset voltage error. The mode switch circuit switches to the calibration mode in a synchronous manner, such as on a regular timing interval, or in an asynchronous manner, such as when one or more monitored variables (e.g., difference voltage between the feedback nodes) indicates that the offset voltage error is greater than a predetermined threshold. During the calibration mode, the mode switch circuit decouples the current device from the BG node to open the closed control loop, and shorts the inputs of the error amplifier together. The mode switch also couples the current generator to sink a first mirrored current from the current device and to source a second mirrored current to the input node of the diode junction circuit during the calibration mode. During the calibration mode, the calibration circuit monitors the output of the current device while adjusting a trim current of the error amplifier to minimize the offset voltage error.

In one embodiment, the first and second mirrored currents have nominal magnitudes that are equivalent to a nominal magnitude of the BG current. The current generator may generate a current based on a difference between the gate-to-source voltages of a pair of MOS transistors divided by a resistance, or $\Delta V_{GS}/R_S$, whereas the control current of the BG circuit is based on a difference between the emitter-base voltages of a pair of bipolar junction transistors divided by a resistance, or $\Delta VEB/R_2$. In this manner, the two currents track each other across the resistor corners and to some extent over the operating temperature range.

In one embodiment, the calibration circuit includes a trimming controller and a trimming digital to analog converter (DAC). During the calibration mode, the trimming controller monitors the voltage at the output of the current device and adjusts a digital trim value provided to the trimming DAC. The trimming DAC converts the digital trim value to the trim current of the error amplifier. In one embodiment, the error amplifier includes first and second trim nodes (e.g., left and right or positive and negative or the like) in which the trimming DAC adjusts the relative trim current between the two trim nodes until the offset voltage error is minimized. During the calibration mode, the error amplifier is operated as a comparator and one or more bits of the digital trim value are tested, one bit at a time, to adjust the relative trim current. A low-temperature coefficient current generator may be provided to develop a reference trim current using the band gap voltage, in which the trimming DAC uses the reference trim current to establish the trim currents applied to the error amplifier.

FIG. 1 is a simplified schematic and block diagram of a BG circuit 100 implemented according to one embodiment of the present invention. A current source 101 coupled to a source voltage VDD provides a bias current $I_{BIAS}$ to an error amplifier 102. The error amplifier 102 has an output providing a drive voltage VDRV on a drive node 103, which is coupled to a gate terminal of a P-channel MOS (PMOS) transistor MPBG. MPBG has a source terminal coupled to VDD and a drain terminal coupled to a sense node 104. The sense node 104 is coupled to a first switched terminal of a single-pole, single-throw (SPST) switch 106, having a second switched terminal coupled to an input node 108. In the illustrated embodiment, the input node 108 develops a band gap voltage VBG, although the band gap voltage may be developed on different nodes in different configurations. The switch 106 has a control terminal receiving a control signal SW4. The input node 108 is coupled to one terminal of a resistor 110, which has its other terminal coupled to a first feedback node 112 developing a voltage VX. The input node 108 is also coupled to one terminal of another resistor 114, which has its other terminal coupled to a second feedback node 116 developing a voltage VY. Node 112 is coupled to an emitter terminal of a diode-coupled bipolar junction transistor (BJT) Q1, having its base and collector terminals coupled together to ground (GND). Node 116 is coupled to one terminal of another resistor 118, which has its other terminal coupled to an emitter terminal of another diode-coupled BJT Q2. The base and collector terminals of Q2 are also coupled together to GND. The feedback node 112 developing the voltage VX is coupled to the negative (or inverting) input terminal of the error amplifier 102, and the feedback node 116 developing the voltage VY is coupled to the positive (or non-inverting) input terminal of the error amplifier 102.

The resistors 110, 114, 118 and the transistors Q1 and Q2 collectively form a diode junction circuit 120. In the illustrated embodiment, the resistors 110 and 114 each have the same resistance R1 and the resistor 118 has a different resistance R2. In alternative embodiments, the resistors 110, 114, 118 may have different resistances. The transistors Q1 and Q2 have a size ratio of 1:X, in which "X" is a positive integer greater than 1. In one embodiment, Q2 may be implemented as X transistors connected in parallel, in which each transistor of Q2 is substantially identical to Q1. Each of the transistors Q1 and Q2 are diode-coupled having their base and collector terminals coupled together to form a diode or "PN" junction. The 1:X size ratio between Q1 and Q2 operated at the same current causes Q1 and Q2 to be operated at different current densities. As described further herein, the value of X and the resistances R1 and R2 are selected so that VBG remains at a fixed voltage level during normal operation regardless of changes of temperature and power supply voltage level (VDD, GND). During normal operation, VBG remains at the fixed voltage level for temperatures within a relatively large operating range of −40° Celsius (C) to 125° C., and VDD within an allowable voltage level range sufficient to sustain circuit operation. Also, VBG remains substantially constant from one integrated circuit (IC) or semiconductor chip to the next within acceptable manufacturing process variables ranges. Further, VBG remains constant over time even with aging effects.

A voltage source 121 is shown interposed between node 116 and the positive input of the error amplifier 102 developing an offset voltage error VOFF. The circular symbol representing the voltage source 121 is shown with a dashed line denoting that it is not a physical voltage source but instead represents the equivalent offset voltage error developed within the error amplifier 102. As described further herein, the BG circuit 100 is periodically operated in a calibration mode to perform a calibration procedure in which the error amplifier 102 is trimmed or calibrated to minimize the voltage level of VOFF to 0 Volts (V) or to at least a negligible voltage level. The BG circuit 100 is also operated in a normal mode for normal operation in which VOFF can be ignored or assumed to be 0V. The time for performing the calibration is minimal and substantially less than the duration of the normal operating mode.

The BG circuit 100 includes additional components for purposes of calibrating the error amplifier 102 during the calibration mode and for switching between the normal and calibration operating modes. Another SPST switch 122 has its switched terminals coupled between the positive and negative inputs of the error amplifier 102 and has a control terminal receiving a control signal SW1. A current source 124 referenced to VDD has an output sourcing a current IBG2 to one switched terminal of another SPST switch 126, having its other switched terminal coupled to the input node 108 and having a control terminal receiving a control signal SW2. The current IBG2 is provided to the diode junction circuit 120 via node 108 when the switch 126 is closed. Another SPST switch 128 has its switched terminals coupled between node 104 and an input of a current sink 130 and receives a control signal SW3. The current sink 130 has an output that sinks a current IBG1 to GND when the switch 128 is closed. A mode controller 136 communicates with a trimming controller 132 via a pair of control signals CAL_STRT and CAL_STOP, in which the trimming controller 132 performs calibration of the error amplifier 102 when CAL_STRT is asserted to initiate the calibration mode. During the calibration procedure, the trimming controller 132 monitors a sense voltage VBGS at node 104, toggles a control signal SW6 as further described herein, and has an output that updates an N-bit digital trim value $D_{TRIM}$ provided to a trimming digital-to-analog converter (DAC) 134. In one embodiment, $D_{TRIM}$ is a 13-bit value for 12-bit accuracy, although different sized digital values are contemplated for different configurations. Once the calibration procedure is completed, the trimming controller 132 asserts CAL_STOP to the mode controller 136, which reconfigures the BG circuit 100 back to the normal mode to resume normal operations.

The trimming DAC 134 receives a reference trim current $I_{TRIM_REF}$ and is coupled to a pair of trim nodes of the error amplifier 102 for drawing corresponding trim currents $I_{TRIM_L}$ and $I_{TRIM_R}$. $I_{TRIM_REF}$ is used to establish the initial or nominal magnitudes of $I_{TRIM_L}$ and $I_{TRIM_R}$ when equally balanced. As described further herein, the trimming DAC 134 balances the relative trim current drawn from the trim nodes based on the reference trim current $I_{TRIM_REF}$, and during the calibration mode, adjusts the relative trim currents at the trim nodes based on the digital trim value $D_{TRIM}$. The relative trim currents $I_{TRIM_L}$ and $I_{TRIM_R}$ are used to reduce or otherwise minimize the offset voltage error VOFF as further described herein. A trim current generator 138 develops $I_{TRIM_REF}$ based on VBG as further described herein.

The error amplifier 102 may be configured as an operational amplifier with a large nominal gain "A" and each of the switches described herein, including the switches 106, 122, 126, and 128 are shown as SPST switches, which may be implemented using MOS transitors, such as PMOS or N-channel MOS (NMOS) transistors or the like.

The mode controller 136 determines the mode of operation and asserts the CAL_STRT control signal to indicate the calibration mode. The mode controller 136 also controls the SW1-SW4 signals and additional control signals SW5 and SW7 to control corresponding switches as further described herein. The operating mode may be determined in any one of several ways. One method is a synchronous method in which calibration is repeated between regular timing intervals. The calibration procedure may be repeated at a relatively low frequency, such as, for example, 1 Hertz (Hz) or once every second. The timing interval should be sufficiently long to avoid significant interruption and sufficiently frequent to minimize VOFF. The timing interval may be implemented using a timer or the like (not shown) to establish a fixed interval between calibration periods.

In an alternative embodiment, the mode controller 136 monitors one or more operating parameters and enters calibration mode in an asynchronous manner when any one of one or more thresholds have been reached. For example, the mode controller 136 may monitor the difference between the voltages VX and VY, and perform calibration when a difference between VX and VY exceeds a predetermined threshold voltage level. Alternatively, or in addition, the mode controller 136 may receive a temperature value indicative of ambient temperature, and may enter calibration mode when the temperature changes by a predetermined amount. Once the trimming controller 132 has completed the calibration procedure, it asserts CAL_STOP to the mode controller 136, which switches operation back to the normal mode.

During the normal mode, the mode controller 136 asserts SW4 to close the switch 106 and asserts SW1 to open the switch 122, which places the error amplifier 102 in a closed-loop configuration with MPBG and the diode junction circuit 120. The mode controller 136 also asserts SW2 and SW3 to open the switches 126 and 128 to remove the current source 124 and the current sink 130 from the circuit. During the normal mode, the error amplifier 102 controls VDRV so that MPBG operates as a current device that drives a control current MG to node 108 into the diode junction circuit 120 to maintain the voltages VX and VY equal to each other. The emitter-base voltage of Q1 is VEB1, the emitter-base voltage of Q2 is VEB2, and the difference in emitter-base voltages of Q1 and Q2 is VEB1−VEB2=ΔVEB. ΔVEB is proportional to temperature (T) or ΔVEB=Vt*ln (X), where Vt is the thermal voltage kT/q, an asterisk "*" denotes multiplication, "k" is Boltzmann's constant, "q" is electronic charge, "ln" denotes the natural logarithm, and "X" is the size ratio between Q1 and Q2. Assuming VX=VY according to normal circuit operation during the normal mode, the voltage ΔVEB is imposed across the resistor 118 (with resistance R2), so that the output voltage VBG on node 108 is VBG=VEB2+ΔVEB*(R1+R2)/R2. VEB2 has a negative temperature coefficient whereas ΔVEB*(R1+R2)/R2 has a positive temperature coefficient, in which the size ratio X and the resistances R1 and R2 are selected so that VBG remains constant.

In a more specific configuration for a 40 nanometer (nm) process, X is 48, R1 is 114*RU, R2 is 25*RU, and RU is a unit resistance (e.g., RU=1.65 Kilohms (kΩ)), so that the ratio (R1+R2)/R2=5.56. These values are exemplary only and may vary significantly from one implementation to another or for different manufacturing processes. For any given implementation and/or manufacturing process, the values X, R1 and R2 are chosen or trimmed so that VBG remains constant.

The normal operating mode assumes that VOFF is 0V or at least negligibly small. Assuming, for the moment, that the offset voltage error VOFF is not small so that VX and VY are driven to different voltages, then the band gap voltage VBG deviates from its target voltage level and may not remain substantially fixed over temperature and/or voltage variations. The calibration process as described herein is designed to minimize VOFF so that VBG remains substantially constant with a high degree of accuracy over time in spite of temperature and/or voltage variations. In one embodiment, VBG has and maintains 12 bits of accuracy regardless of temperature, process, and voltage variables. This accuracy is achieved without the need for an additional IC pin, without laser trimming, and without excessively large and expensive capacitors.

During the calibration mode, the mode controller 136 asserts SW4 to open the switch 106, and asserts SW1, SW2 and SW3 to close the switches 122, 126, and 128. Closing the switch 122 shorts the inputs of the error amplifier 102 together which effectively places the offset voltage error VOFF across the error amplifier inputs. Opening the switch 106 opens the closed-loop configuration and decouples MPBG from the diode junction circuit 120. Closing the switch 126 places the current source 124 into the circuit so that the current IBG2 is provided to node 108 and into the diode junction circuit 120. IBG2 is designed to be about equal to IBG so that the input voltage of the error amplifier 102 becomes relatively close to its common mode input voltage during the normal mode. Closing the switch 128 places the current sink 130 into the circuit so that the current IBG1 is drawn from node 104 to GND, in which IBG1 is also designed to be about equal to IBG. Since opening the switch 106 opens the loop, the error amplifier 102 operates as a comparator during the calibration mode while MPBG and IBG1 operate as a second stage for the comparator.

As described further herein, the mode controller 136 also asserts SW7 (FIG. 4) to decouple VBG and asserts SW5 (FIG. 3) to remove output capacitance of the error amplifier 102 during the calibration mode. During the calibration process, the trimming controller 132 performs a binary search or successive approximation algorithm by controlling SW6 (FIG. 3) and by monitoring VBGS while adjusting the bits of the digital trim value $D_{TRIM}$. In response, the trimming DAC 134 adjusts the relative trim currents $I_{TRIM_L}$ and $I_{TRIM_R}$ to trim the error amplifier 102 to eliminate or otherwise minimize VOFF. In one embodiment, the bits of $D_{TRIM}$ are changed one at a time from the most significant bit (MSB) to the least significant bit (LSB) while the output of the second stage, or VBGS, is monitored. Each bit-under-test (BUT) is set to a logic one and VBGS is monitored to detect the state of the comparator via VBGS. If VBGS stays high, then the BUT remains as a logic one, but otherwise the BUT is set to logic zero. Once the calibration procedure is completed, the trimming controller 132 signals to the mode controller 136, which switches the BG circuit 100 back to the normal mode.

FIG. 2 is a schematic diagram of a bias current generator 200 implemented according to one embodiment of the present invention for developing the currents $I_{BIAS}$, IBG1 and IBG2. The bias current generator 200 collectively performs the functions of the current sources 101 and 124 and the current sink 130. PMOS transistors MP1, MP2, MP3, MP4, and MP5 each have their source terminals coupled to VDD and their gate terminals coupled together at a common gate node 202. MP1 has its drain terminal also coupled to node 202, which is further coupled to the drain terminal of an NMOS transistor MN1. The gate terminal of MN1 is coupled to a node 204, which is further coupled to the drain terminal of MP2 and to the gate and drain terminals of another NMOS transistor MN2. The source terminal of MN2 is coupled to GND. The source terminal of MN1 is coupled to one end of a reference resistor 206 having a reference resistance $R_S$, having its other terminal coupled to GND. The drain terminal of MP3 is coupled to the drain and gate terminals of an NMOS transistor MN3 and to the gate terminal of another NMOS transistor MN4 at a node 208. The source terminals of MN3 and MN4 are coupled to GND. The drain terminal of MP5 sources $I_{BIAS}$, the drain terminal of MP4 sources IBG2, and the drain terminal of MN4 sinks IBG1. MN2 and MN1 have a size relationship of 1:P, in which "P" is a positive number greater than zero.

The bias current generator 200 is a constant transconductance, current mirror circuit that generates a reference current $I_S=(VGS2-VGS1)/R_S=\Delta VGS/R_S$, where VGS2 and VGS1 are the gate-to-source voltages of MN2 and MN1, respectively. The current $I_S$ flows through MP1 and is mirrored through MP3 and MN3. In one embodiment, MP3 is in a mirrored configuration with MP1 and has the same size as MP1, so that MP3 also sources $I_S$ through MN3, which is also sized to sink the same current $I_S$. MN4 is sized relative to MN3 to develop IBG1, and MP4 is sized relative to MP3 to develop IBG2. The relative size relationship between MP4 and MP3 is the same as the relative size relationship between MN4 and MN3, so that IBG2=IBG1. MP5 also has a selected size relationship with MP3 so that $I_{BIAS}$ has the appropriate bias current level for use by the error amplifier 102. MP1 and MP2 can have a size ratio of 1:1.

The current IBG developed in the BG circuit 100 during normal operation varies with temperature and other circuit variations in order to maintain VBG at the fixed voltage level as previously described. It is noted however, the current IBG has a "nominal" value $IBG_{NOM}$ under nominal operating conditions during the normal operating mode. For example, when VDD is at a selected nominal voltage level, and when the ambient temperature is at a nominal temperature level, such as a room temperature of 25° C., then IBG is at the $IBG_{NOM}$ level. Under these same nominal operating conditions, IBG1 and IBG2 are both configured to have the same nominal value $IBG_{NOM}$, or IBG1=IBG2=$IBG_{NOM}$. In one embodiment, for example, $IBG_{NOM}$=5 microamperes (μA), so that IBG1 and IBG2 are also both nominally set to 5 μA, in which $I_S$=1 μA, MP4 is 5× the size of MP3 and MN4 is 5× the size of MN3. Although IBG varies from $IBG_{NOM}$ during normal operation and may also vary relative to IBG1 and IBG2, the differences between these currents are relative small and thus are considered essentially equivalent to each other.

It is further noted that IBG1 and IBG2 are both proportional to $\Delta VGS/R_S$ while the control current IBG is proportional to ΔVEB/R2. Consequently, the effect of process variations in the resistors ($R_S$, R1, R2) cancel out since such variations affect the two currents in the same manner. In addition, both ΔVGS and ΔVEB are proportional to temperature, so that the relative temperature effect is also cancelled out. $\Delta VGS/R_S$ tracks ΔVEB/R2 across resistor corners and across the operating temperature range. The constant-gm bias current IBG2 for setting the input voltage of the error amplifier 102 during calibration is relatively close to the common mode voltage of the inputs of the error amplifier 102 during normal operation. The constant-gm bias current IBG1 used as a bias for the second stage during the calibration mode reduces the calibration time significantly. It is noted that reducing the calibration time reduces overall power consumption.

FIG. 3 is a schematic and block diagram of the error amplifier 102 implemented according to one embodiment of the present invention. A pair of PMOS transistors MP1_L and MP1_R each have their source terminals coupled to VDD and their gate terminals coupled together at a node 302 developing a voltage VDIO. The drain terminal of MP1_L is coupled to the source terminal of another PMOS transistor MP2_L at a first trim node 304 developing a trim voltage $V_{TRIM_L}$. The trim current $I_{TRIM_L}$ is shown drawn from node 304. The drain terminal of MP2_L is coupled to the drain terminal of an NMOS transistor MN2_L at node 302. The source terminal of MN2_L is coupled to the drain terminal of another NMOS transistor MN1_L, which has its drain terminal coupled to a common node 306. The drain terminal of MP1_R is coupled to the source terminal of another PMOS transistor MP2_R at a second trim node 308 developing a trim voltage $V_{TRIM_R}$. The trim current $I_{TRIM_L}$ is shown drawn from node 308. The drain terminal of MP2_R is coupled to the drain terminal of an NMOS transistor MN2_R at the output of the error amplifier 102, which is coupled to the drive node node 103 developing the drive voltage VDRV. The source terminal of MN2_R is coupled to the drain terminal of another NMOS transistor MN1_R, which has its source terminal coupled to the common node 306. A SPST switch 312 has its switched terminals coupled between VDD and one terminal of a compensation capacitor 314 having capacitance CC. The other terminal of the capacitor 314 is coupled to the drive node 103 and the control input of the switch 312 receives the control signal SW5. Another SPST switch 315 has its switched terminals coupled between nodes 302 and 103 and has a control input receiving the control signal SW6.

A cascode voltage generator 316 develops cascode voltages VCASP and VCASN, in which VCASP is provided to the gate terminals of MP2_L and MP2_R, and in which VCASN is provided to the gate terminals of MN2_L and MN2_R. The gate terminal of MN1_L forms the positive input (V+) and the gate terminal of MN1_R forms the negative input (V−) of the error amplifier 102. $I_{BIAS}$ is provided to a node 318, which is also coupled to the drain and gate terminals of an NMOS transistor MCS_1 and to the gate terminal of another NMOS transistor MCS_2. The source terminals of MCS_1 and MCS_2 are coupled to GND, and the drain terminal of MCS_2 is coupled to the common node 306.

The transistors MCS_1 and MCS_2 are coupled in a current mirror configuration so that the drain current $I_{TAIL}$ through MCS_2 is proportional to the drain current $I_{BIAS}$ through MCS_1. $I_{TAIL}$ splits between the left branch (denoted as "_L") and the right branch (denoted as "_R") depending upon the relative trim voltages $V_{TRIM_L}$ and $V_{TRIM_R}$ and the relative input voltages V+ and V−. Assuming that the relative trim currents $I_{TRIM_L}$ and $I_{TRIM_R}$ are adjusted to minimize VOFF, then operation of the error amplifier 102 is determined by the relative levels of the input voltages V+ and V−. During the normal mode, the mode controller 136 asserts SW5 to close the switch 312 and the trimming controller 132 asserts SW6 to open the switch 315 so that the error amplifier 102 drives VDRV with high gain to equalize V+ and V−.

During the normal mode, the switch 312 is closed so the output is coupled to the supply through the compensation capacitor 314 used to stabilize the closed loop configuration. As described further below, the trimming DAC 134 sinks the trim currents $I_{TRIM_L}$ and $I_{TRIM_R}$ from the trim nodes 304 and 308, respectively, during normal operation, in which the two trim currents are set by the digital trim value $D_{TRIM}$ by the trimming controller 132 during the calibration mode. The two trimming currents are set so that the difference between them generates an equivalent input voltage that cancels VOFF. It is noted that the difference between these two trim currents can be as low as 1 nA or few hundreds of picoamperes (pA) in some configurations. The NMOS input transistors MN1_L and MN1_R are used along with NMOS cascode transistors MN2_L and MN2_R to increase the output impedance of the error amplifier 102. Similarly, PMOS cascode transistors are used in series with the PMOS load to increase the output impedance and, as a consequence, increase the amplifier gain.

During the calibration mode, the mode controller 136 asserts SW5 to open the switch 312 to decouple the compensation capacitor 312. In this manner, the output current of the error amplifier 102 does not have to charge or discharge the compensation capacitor 314 for each bit decision period so that the calibration procedure can be completed in a substantially shorter amount of time. At the beginning of each bit decision period during the calibration procedure, the trimming controller 132 asserts SW6 to momentarily close the switch 315 for a relatively short period of time to set the initial voltage of VDRV to be equal to VDIO, which is the gate voltage of MP1_L and MP1_R, and then the switch 315 is opened for the remainder of the bit decision period. This is repeated for each bit decision during calibration.

In one embodiment, the transistors MP1_L, MP1_R and MPBG are sized to have relatively the same current density. In this manner, the threshold voltage of the second stage consisting of MPBG and the current source 130, which is the VDRV voltage level that sets the output voltage of the second stage, or VBGS, to mid-rail, is approximately VDIO. The period in which the switch 315 is closed for each bit decision is called a reset period and is a relatively short period of time when compared to the time between successive calibration procedures. In one embodiment, the reset period is 1 microsecond (μs), although the reset period may be different for different configurations. Since $I_{TAIL}$, which sets the current in MP1_R and MP1_R, and IBG1, are both generated using the same bias current generator 200 as shown in FIG. 2, relatively equal current densities occur for MP1_R, MP1_L and MPBG during the calibration procedure.

Figure 4:
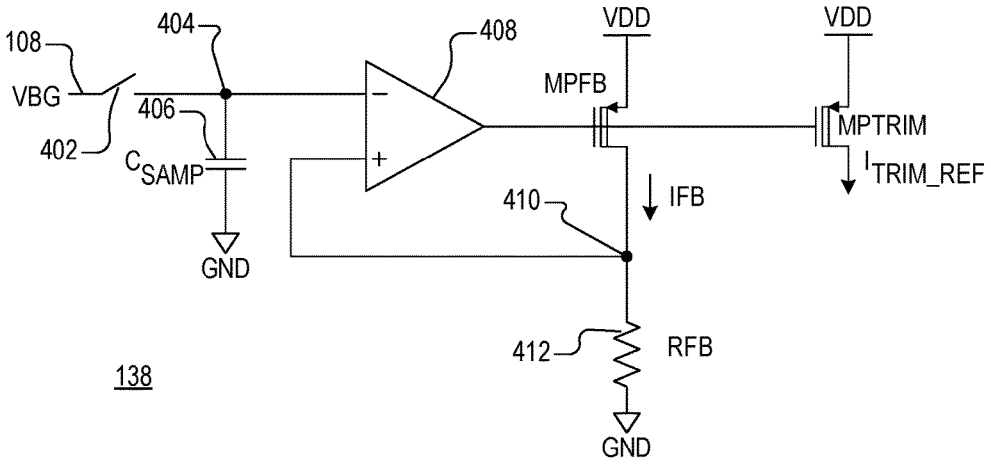
FIG. 4 is a schematic diagram of the trim current generator of FIG. 1 implemented according to one embodiment of the present invention for developing a reference trim current used by the trimming DAC.

FIG. 4 is a schematic diagram of the trim current generator 138 implemented according to one embodiment of the present invention for developing the reference trim current $I_{TRIM_REF}$ used by the trimming DAC 134. Since the digital trim value $D_{TRIM}$ sets the difference between the trim currents $I_{TRIM_L}$ and $I_{TRIM_R}$ drawn from the trim nodes 304 and 308 of the error amplifier 102, that difference should not change with temperature in order to maintain offset voltage error cancellation in the event of temperature changes. In other words, if the current changes with temperature, the reference trim current $I_{TRIM}$ changes and the offset cancellation changes causing VOFF, and thus VBG, to change. Consequently, the bias current generator 200 is not used to generate the reference trim current $I_{TRIM_REF}$ since its output current is proportional to the temperature.

Instead, the trim current generator 138 generates $I_{TRIM_REF}$ in such a manner that it is relatively constant with temperature. Any temperature dependence is negligible especially given the short calibration time period compared to the significantly longer periods for normal operation. VBG is provided to one switched terminal of a SPST sample switch 402, having its other switched terminal coupled to a hold node 404 and having its control input receiving the control signal SW7. The hold node 404 is further coupled to one terminal of a sample capacitor 406 and to the negative input of an amplifier 408. The other terminal of the sample capacitor 406, having capacitance $C_{SAMP}$, is coupled to GND. The output of the amplifier 408 is coupled to the gate terminals of a pair of PMOS transistors MPFB and MPTRIM. The source terminals of MPFB and MPTRIM are coupled to VDD. The drain terminal of MPFB is coupled to a feedback node 410, which is further fed back to the positive input of the amplifier 408 and coupled to one end of a feedback resistor 412 having resistance RFB. The feedback resistor 412 may be implemented as a low temperature coefficient resistor. The other end of the resistor 412 is coupled to GND. The drain terminal of MPTRIM provides the reference trim current $I_{TRIM_REF}$.

During the normal mode, the mode controller 136 asserts SW7 to close the sample switch 402 so that the sample capacitor 406 remains charged at VBG. The amplifier 408 drives MPFB to develop a feedback current IFB through the feedback resistor RFB so that the feedback node 410 is driven to the same voltage level as VBG. When the feedback resistor 412 is implemented as a low temperature coefficient resistor, the feedback current IFB has little dependency on temperature. MPTRIM is coupled in a current mirror configuration with MPFB, so that $I_{TRIM_REF}$ is developed based on VBG and thus remains substantially independent of temperature during normal operation. During the calibration mode, the mode controller 136 asserts SW7 to open the sample switch 402. The sample capacitor 406 remains charged at substantially the same voltage as VBG during the calibration procedure. The trim current generator 138 maintains the levels of VBG and $I_{TRIM_REF}$ during the relative short calibration period, so that the reference trim current remains available during calibration. As soon as the calibration procedure is over, the mode controller 136 asserts SW7 to re-close the sample switch 402 to switch to the normal mode for normal operations.

It is noted that the amplifier 408 may also have an input offset voltage error. It can be shown, however, that since RFB>>RX in which RX is the net effective resistance in the trimming DAC 134, the net effect of the input offset voltage error of the amplifier 408 on the trim voltages $V_{TRIM_L}$ and $V_{TRIM_R}$ is negligibly small.

Figure 5:
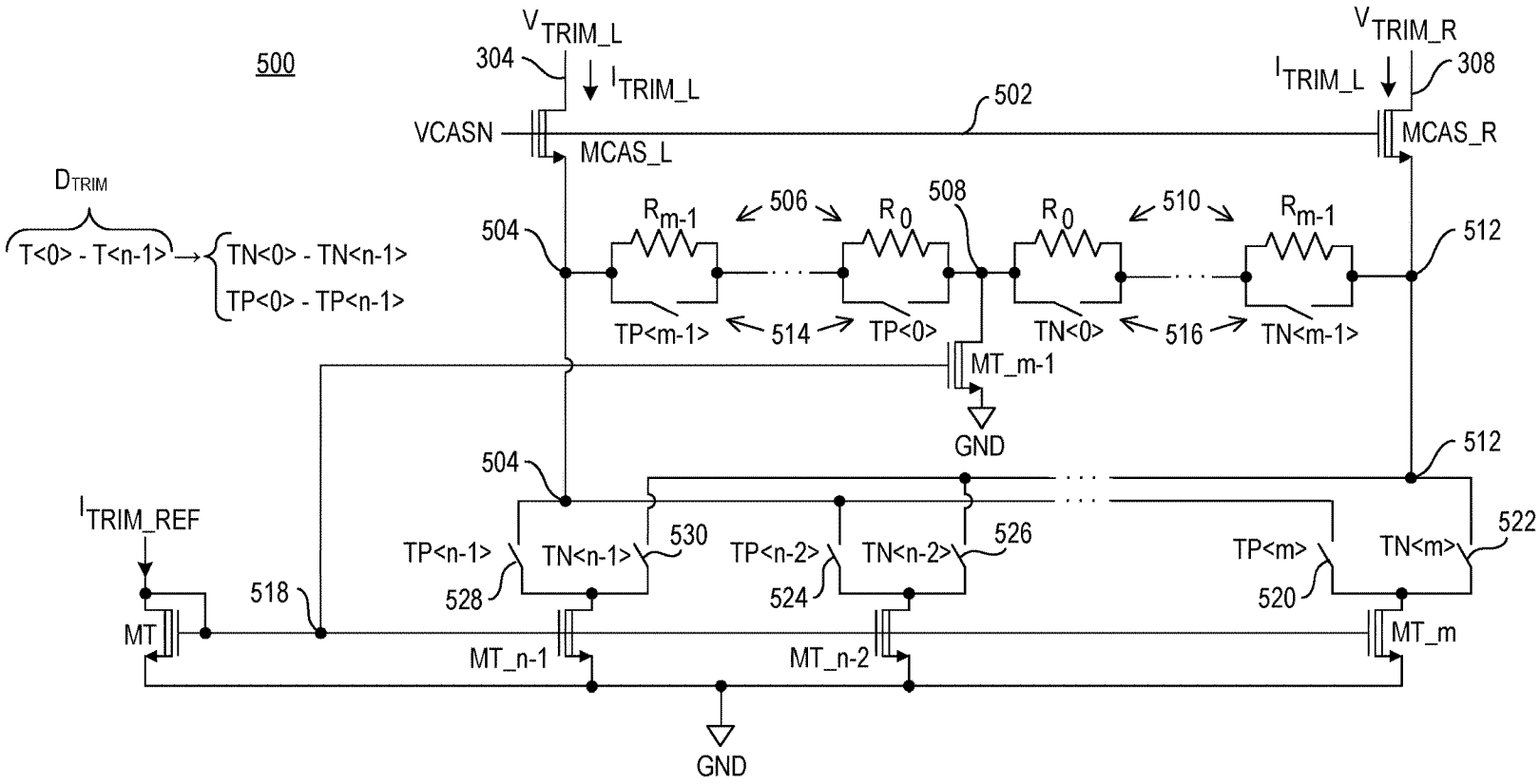
FIG. 5 is a schematic diagram of a trimming DAC implemented according to one embodiment of the present invention which may be used as the trimming DAC of FIG. 1.

FIG. 5 is a schematic diagram of a trimming DAC 500 implemented according to one embodiment of the present invention, which may be used as the trimming DAC 134. The trimming DAC 500 is configured to steer the trim currents $I_{TRIM_L}$, and $I_{TRIM_R}$ between nodes 304 and 308 based on the digital trim value $D_{TRIM}$. The nominal magnitudes of the trim currents $I_{TRIM_L}$, and $I_{TRIM_R}$ are established by $I_{TRIM_REF}$, in which steering means that one of the trim currents $I_{TRIM_L}$ and $I_{TRIM_R}$ is reduced while the other is increased or vice-versa. Node 304 developing the trim voltage $V_{TRIM\ L}$ is coupled to the drain terminal of an NMOS transistor MCAS_L, having its gate terminal coupled to a node 502 and its source terminal coupled to a node 504. The cascode voltage VCASN from the cascode voltage generator 316, or any other suitable bias voltage, may be provided to node 502. A first set of resistors forming a first resistor array 506 are coupled in series between node 504 and an intermediate node 508, and a second set of resistors forming a second resistor array 510 are coupled in series between the intermediate node 508 and anode 512. Node 308 developing the trim voltage $V_{TRIM\ R}$ is coupled to the drain terminal of another NMOS transistor MCAS_R, having its gate terminal coupled to node 502 and its source terminal coupled to the node 512. The switched terminals of a first array of SPST switches 514 are coupled in series between nodes 504 and 508 and the switched terminals of a second array of SPST switches 516 are coupled in series between nodes 508 and 512. Each switch of the first array of switches 514 is coupled in parallel with a corresponding one of the resistors of the resistor array 506, and each switch of the second array of switches 516 is coupled in parallel with a corresponding one of the resistors of the resistor array 510.

The reference trim current $I_{TRIM_REF}$ is mirrored and distributed by a current mirror configuration including a main NMOS transistor MT and a set of NMOS transistors MT_Z (in which "Z" ranges from m−1 to n−1 in with "m" and "n" are integers and n>m). The reference trim current $I_{TRIM_REF}$ is provided to the drain terminal of MT, which has its drain and gate terminals coupled together at node 518 and its source terminal coupled to GND. The intermediate node 508 is coupled to the drain terminal of an NMOS transistor MT_m−1, having its gate terminal coupled to a node 518 and its source terminal coupled to GND. In this manner, a current proportional to $I_{TRIM_REF}$ is mirrored through MT_m−1 and split between $I_{TRIM_L}$ drawn from node 304 and $I_{TRIM_R}$ drawn from node 308 depending upon the LSB bits of the digital trim value $D_{TRIM}$. For the MSB bits, another set of transistors MT_m to MT_n−1 each have its gate terminal coupled to node 518 and its source terminal coupled to GND. As described further below, the drain terminal of each of the transistors MT_m to MT_n−1 is coupled to the node 504 through a first SPST switch and is coupled to the node 512 through a second SPST switch as controlled by the MSB bits of the digital trim value $D_{TRIM}$.

The digital trim value $D_{TRIM}$ includes N bits T<0> to T<n−1>, which are divided into two groups including an LSB group including bits T<0> to T<m−1>, and an MSB group including bits T<m> to T<n−1>. The bits T<0> to T<n−1> are further separated into a positive group TP<0> to TP<n−1> and a negative group TN<0> to TN<n−1>, in which the bits of the negative group are asserted to opposite states of the corresponding bits of the positive group. The LSB group controls each switch of the first and second arrays of switches 514 and 516. Each LSB bit controls two control signals for controlling two LSB switches, including a first switch in the first array of switches 514 and a corresponding second switch in the second array of switches 516. The LSB bit T<0> controls a first bit TP<0> of the positive group and a corresponding second bit TN<0> of the negative group, in which TP<0> and TN<0> are asserted to opposite logic states with respect to each other based on bit T<0>. For example, in one embodiment when bit T<0> is logic 0, then TP<0> is logic 0 while TN<0> is logic 1 (or vice-versa). TP<0> controls a first switch in the first array of switches 514 coupled in parallel with a first resistor labeled $R_0$ in the first resistor array 506, and TN<0> controls a first switch in the second array of switches 516 coupled in parallel with a first resistor labeled $R_0$ in the second resistor array 510. Although not shown, LSB bit T<1> controls bits TP<1> and TN<1>, in which TP<1> controls a second switch of the first array of switches 514 coupled in parallel with a second resistor $R_1$ in the first resistor array 506, and TN<1> controls a second switch in the second array of switches 516 coupled in parallel with a second $R_1$ in the second resistor array 510. This pattern repeats up to the last LSB bit T<m−1>, which controls bits TP<m−1> and TN<m−1> each controlling a corresponding one of the last switches of the first and second arrays of switches 514 and 516 coupled in parallel with a corresponding one of the last resistors $R_{m-1}$ of the resistor arrays 506 and 510.

The n-m MSB bits of the digital trim value $D_{TRIM}$ control the set of switches corresponding to the transistors MT_m to MT_n−1 for selectively coupling the drain of each transistor to one of the nodes 504 and 512. Thus, each MSB bit steers a corresponding scaled current between $I_{TRIM_L}$ or $I_{TRIM_R}$. The transistor MT_m is associated with the MSB bit T<m> and has its drain terminal coupled to one switched terminal of each of a first switch 520 and a second switch 522. The other switched terminal of switch 520 is coupled to node 504 and is controlled by a bit TP<m>, and the other switched terminal of switch 522 is coupled to node 512 and is controlled by a bit TN<m>. The MSB bit T<m> controls the bits TP<m> and TN<m> to opposite logic states in a similar manner described for the LSB bits, so that only one of the switches 520 and 522 is closed at a time. This pattern repeats for the remaining MSB bits T<m+1> to T<n−1>. As shown, for example, the transistor MT_n−2 is associated with the MSB bit T<n−2> and has its drain terminal coupled to one switched terminal of each of a first switch 524 and a second switch 526. The other switched terminal of switch 524 is coupled to node 504 and is controlled by a bit TP<n−2>, and the other switched terminal of switch 526 is coupled to node 512 and is controlled by a bit TN<n−2>. The MSB bit T<n−2> controls TP<n−2> and TN<n−2> to opposite logic states so that only one of the switches 524 and 526 is closed at a time. In a similar manner, the transistor MT_n−1 is associated with MSB bit T<n−1>, which controls a bit TP<n−1> for controlling a first switch 528 for selectively coupling the drain terminal of MT_n−1 to node 504, and which controls a bit TN<n−1> for controlling a second switch 530 for selectively coupling the drain terminal of MT_n−1 to node 512. The logic state of MSB bit T<n−1> controls TP<n−1> and TN<n−1> to opposite states so that the drain terminal of MT_n−1 is coupled to either node 504 or 512. Each of the transistors MT_m to MT_n−1 sink a scaled version of the reference trim current $I_{TRIM_REF}$, in which each scaled trim current is steered between $I_{TRIM_L}$ or $I_{TRIM_R}$ based on the corresponding MSB bit. For example, if the MSB bit T<n−1> is set to close switch 528 while opening switch 530, then the scaled current through MT_n−1 is pulled from node 304.

The m LSB bits are implemented using a pair of programmable resistor arrays where each array consists of m resistors, $R_0$ to $R_{m-1}$. The transistor MT_m−1 mirrors a scaled version of $I_{TRIM_REF}$ which is split between the two directions based on the LSB trimming bits. Based on the value of the trimming bits T<m−1>:T<0>, some of the resistors are shorted in one array by closing their corresponding switches while their counterparts in the other array are not shorted. For example, if bit T<0> causes TP<0> to close its switch and TN<0> to open its switch, then resistor $R_0$ is removed from the resistor array 506 and inserted into the resistor array 510. Consequently, the ratio between the MT_m−1 current that is flowing either to the right or the left can be controlled in very fine steps. In order to maintain relatively same voltage for the right and left terminals of the trimming resistor array, the gate terminals of MCAS_L and MCAS_R are driven by the same voltage. For simplicity of design, the cascode voltage VCASN is reused, although an alternative bias voltage may be used in the alternative.

In a theoretical configuration with perfectly matching transistors using a theoretically perfect manufacturing process, the transistors MT_m to MT_n−1 may have a binary size distribution so that one transistor to the next scales exactly by a factor of two from one bit to the next. A problem that may arise with a current steering DAC, however, is a mismatch between the different current mirror transistors. To overcome this problem, sufficient redundancy may be added to the different bits. If no redundancy is used, the size of the current source transistors used to implement the MSB bits scale down by a factor of two from one bit to the next. When redundancy is added, however, the scaling factor is set to be less than 2, such as, for example, within a range of 1.6 to 1.8. A similar scaling factor may be used for the resistor arrays 506 and 510.

The particular scaling factor used depends on the amount of redundancy needed which depends on the manufacturing process mismatch. Furthermore, redundancy can help reduce the time needed for the comparator to decide on the value of the bits. If there is enough redundancy, it can be used to overcome incorrect comparator decision if the comparator output is evaluated before it is completely settled. Companion bit technique is also used to correct for the incorrect comparator decisions. As an example, during the calibration process, if an incorrect decision is made for a more significant bit using a purely binary progression (e.g., scaling factor of 2), then the remaining lower significant bits are unable to compensate for the error. In a redundant configuration with a scaling factor less than 2, the lower significant bits are able to compensate for an incorrectly determined higher significant bit.

In a redundant configuration for an exemplary scaling factor of 1.8, the size of the transistor MT_n−1 is 1.8 times the size of MT_n−2, which is 1.8 times the size of the transistor MT_n−3, and so on down to the smallest transistor MT_m for the MSB bits. Also, the transistor MT_m is 1.8 times the size of the LSB transistor MT_m−1. In a similar manner for the LSB bits, the resistors may scale down by a factor of 1.8 (or other suitable scaling factor) from one bit to the next. Thus, the resistor $R_{m-1}$ has 1.8 times the resistance of the resistor $R_{m-2}$, which has 1.8 times the resistance of the resistor $R_{m-3}$, and so on down to the smallest resistance $R_0$.

Figure 6:
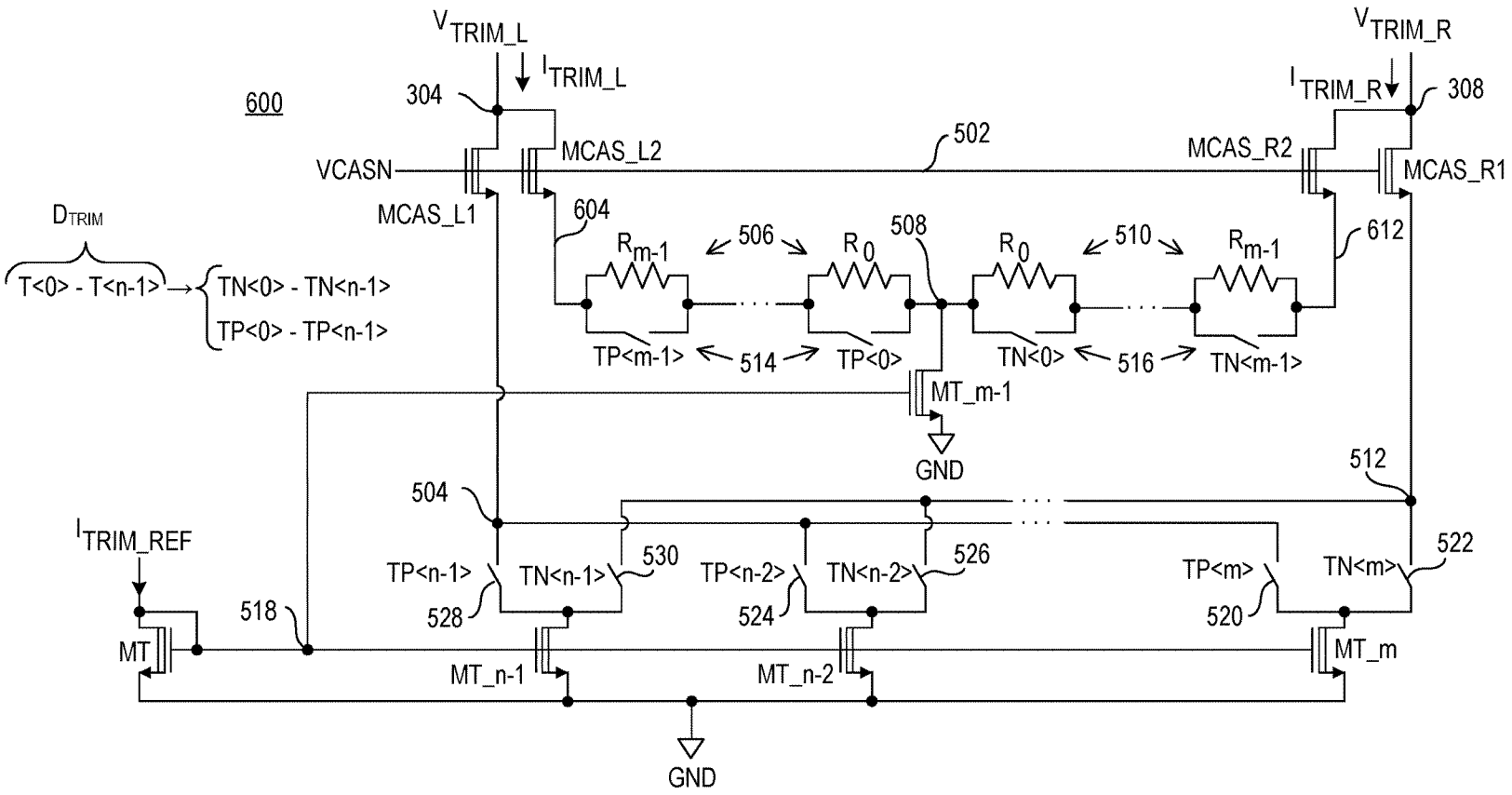
FIG. 6 is a schematic diagram of a trimming DAC implemented according to another embodiment of the present invention, which may also be used as the trimming DAC of FIG. 1.

FIG. 6 is a schematic diagram of a trimming DAC 600 implemented according to another embodiment of the present invention, which may also be used as the trimming DAC 134. The trimming DAC 600 is substantially similar to the trimming DAC 500 in which similar components assume the same reference numerals. For the trimming DAC 600, the cascode transistors MCAS_L and MCAS_R of the trimming DAC 500 are each replaced by a pair of cascode transistors. As shown, MCAS_L on the left side is replaced by MCAS_L1 and MCAS_L2, and MCAS_R on the right side is replaced by MCAS_R1 and MCAS_R2. MCAS_L1 is coupled in similar manner as MCAS_L having its drain terminal coupled to node 304, its gate terminal coupled to node 502, and its source terminal coupled to node 504. MCAS_R1 is coupled in similar manner as MCAS_R having its drain terminal coupled to node 308, its gate terminal coupled to node 502, and its source terminal coupled to node 512. MCAS_L2 has its drain terminal coupled to node 304 and its gate terminal coupled to node 502 in a similar manner as MCAS_L1, but has its source terminal coupled instead to a new node 604. Similarly, MCAS_R2 has its drain terminal coupled to node 308 and its gate terminal coupled to node 502 in a similar manner as MCAS_R1, but has its source terminal coupled instead to another new node 612. The resistor array 506 and the switch array 514 are each decoupled from node 504 and instead coupled between nodes 604 and 508. Similarly, the resistor array 510 and the switch array 516 are each decoupled from node 512 and instead coupled between nodes 508 and 612. In this manner each cascode transistor of the trimming DAC 500 is effectively split into two transistors for the trimming DAC 600, one for the MSB bits and one for the LSB bits. Operation is substantially similar in which $I_{TRIM_REF}$ establishes the nominal magnitudes of $I_{TRIM_L}$ and $I_{TRIM_R}$, which are steered by the bits of $D_{TRIM}$ to minimize VOFF during calibration.

Figure 7:
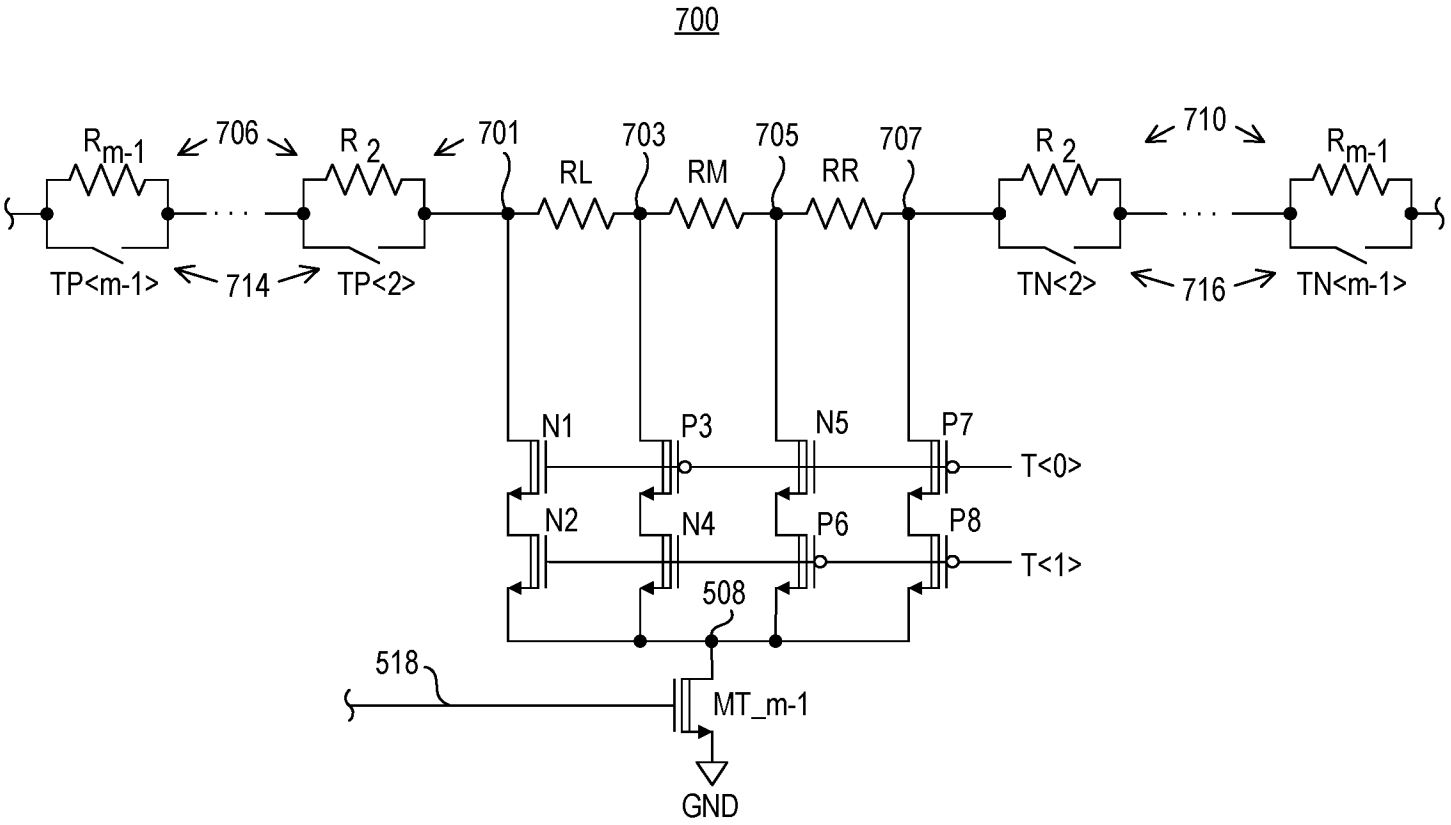
FIG. 7 is a schematic diagram of an LSB circuit that may be used in either of the trimming DACs of FIG. 5 or 6.

FIG. 7 is a schematic diagram of an LSB circuit 700 that may be used in either of the trimming DACs 500 and 600. The LSB circuit 700 replaces the resistor arrays 506 and 510 and the corresponding switch arrays 514 and 516. The LSB circuit 700 includes resistor arrays 706 and 710 replacing the resistor arrays 506 and 510, respectively, and further includes corresponding switch arrays 714 and 716 replacing the switch arrays 514 and 516, respectively. The resistor arrays 706 and 710 and the corresponding switch arrays 714 and 716 are substantially similar to the resistor arrays 506 and 510 and the switch arrays 514 and 516, respectively, except that the resistors R0 and R1 and corresponding switches in each array are replaced by resistors RL, RM, and RR coupled in series. As shown, resistor R2 of the resistor array 706 and corresponding switch are coupled to a node 701 also coupled to the resistor R2, resistor RL is coupled between node 701 and a node 703, resistor RM is coupled between node 703 and a node 705, resistor RR is coupled between node 705 and a node 707, and node 707 is coupled to the resistor R2 of the resistor array 710 and corresponding switch.

Furthermore, four NMOS transistors N1, N2, N4 and N5 and four PMOS transistors P3, P6, P7 and P8 are distributed between node 508 and the nodes 701, 703, 705 and 707. The transistor MT_m−1 is coupled in the same manner with its drain terminal coupled to node 508, its source terminal coupled to GND, and its gate terminal coupled to the node 518. In this manner, the MT_m−1 mirrors a scaled version of the reference trim current $I_{TRIM_REF}$ in similar manner. The drain and source terminals of N1 and N2 are coupled in series between nodes 701 and 508, the drain and source terminals of P3 and N4 are coupled in series between nodes 703 and 508, the drain and source terminals of N5 and P6 are coupled in series between nodes 705 and 508, and the drain and source terminals of P7 and P8 are coupled in series between nodes 707 and 508.

The LSB bit T<0> is provided to the gate terminals of N1, N3, N5 and N7, and the LSB bit T<1> is provided to the gate terminals of N2, N4, N6 and N8. Thus, when the last two bits T<1:0> are 00b ("b" denoting binary), then node 707 is coupled to node 508 through N7 and N8 and the resistors RL, RM and RR are shifted to the left side; when the last two bits T<1:0> are 01b, then node 705 is coupled to node 508 through N5 and N6 so that RR is shifted to the right side and the resistors RL and RM are shifted to the left side; when the last two bits T<1:0> are 10b, then node 703 is coupled to node 508 through N3 and N4 so that RM and RR are shifted to the right side and RL is shifted to the left side; and when the last two bits T<1:0> are 11b, then node 701 is coupled to node 508 through N1 and N2 so that RL, RM and RR are shifted to the right side. Although only the last 2 bits are replaced in the LSB circuit 700, additional last LSB bits may be replaced in a similar manner. Thus, the very last LSB bits, say last 2-4 bits, can be implemented using thermometric code by tabbing or routing the drain terminal of MT_m−1 to different nodes based on the comparator decision of the last LSB bits.

Figure 8:
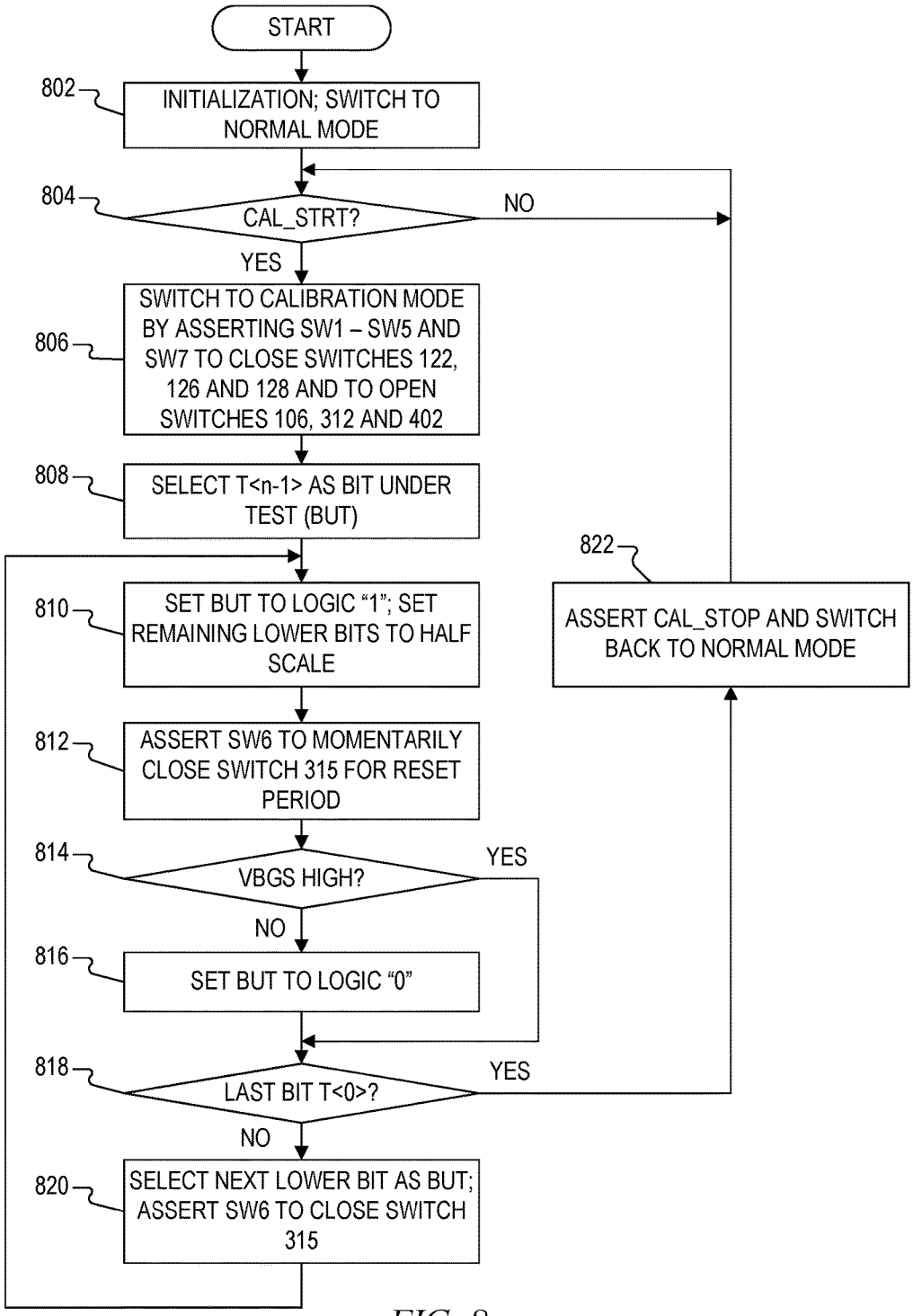
FIG. 8 is a flowchart diagram illustrating an exemplary calibration procedure performed by the BG circuit of FIG. 1 according to one embodiment of the present invention.

FIG. 8 is a flowchart diagram illustrating an exemplary calibration procedure performed by the BG circuit 100 according to one embodiment of the present invention. The illustrated calibration procedure is according to a successive approximation algorithm in which each bit of the digital trim value $D_{TRIM}$ is tested one bit at a time until a final value is determined to minimize VOFF. At a first block 802, initialization is performed, such as at startup or power on or reset (POR), and the mode controller 136 switches to the normal mode. As previously described, SW1-SW6 are asserted to open switches 122, 126, 128 and 315 and to close switches 106, 312, and 402 for normal mode. Operation then proceeds to block 804 to query CAL_STRT for determining when to switch to the calibration mode. Operation loops at block 804 until CAL_STRT is asserted to indicate the calibration mode. The calibration decision may depend upon the particular mode of operation. It may be desired to immediately perform calibration to ensure that VBG is at the appropriate voltage level as soon as possible. When, however, certain parameters are monitored during normal operation, such as the voltage difference between VX and VY, and those parameters indicate that VOFF is below a given threshold, then the calibration mode may be delayed until one or more parameters indicate that calibration is needed.

When it is determined to switch to calibration mode, operation proceeds to block 806 in which the mode controller 136 asserts the SW1-SW5 and SW7 signals to close switches 122, 126, and 128 and to open switches 106, 312, and 402 for the calibration mode. The switch 315 is open during the normal mode and thus is initially open when entering the calibration mode. Operation proceeds to block 808 in which the MSB bit T<n−1> is selected as the bit under test (BUT). Operation then proceeds to block 810 in which the selected BUT is set to logic "1" and the remaining lower bits are set to half scale. In a purely binary configuration with a scaling factor of 2, only the BUT is set to logic "1" and the remaining bits are set to logic "0" since this would represent half scale. In a configuration with redundancy, however, the scaling factor is less than 2 so that additional lower bits are set to bring the total weighting to half scale. The particular bits to set depends on the redundancy factors. The required digital value may be determined beforehand, stored in a memory, and loaded into the trim value $D_{TRIM}$.

At next block 812, SW6 is asserted to momentarily close the switch 315 for the reset period to reset the error amplifier 102. Operation may be temporarily paused until the voltage VBGS settles or otherwise stabilizes during the reset period. VBGS may be monitored to determine when it stabilizes. Alternatively, the switch 315 is closed for a predetermined reset period which assures that the error amplifier 102 has had time to switch and settle. After block 812, operation proceeds to block 814 to query whether VBGS is at a high voltage level. Recall that the error amplifier 102 is configured as a comparator during the calibration mode so that it asserts VBGS either high or low depending upon VOFF and the trim value $D_{TRIM}$. If VBGS is not at a high voltage level (i.e., asserted low), then operation proceeds to block 816 in which the BUT is set to logic "0" rather than logic "1", and operation proceeds to block 818. If, however, VBGS is determined at block 814 to be high, then block 816 is bypassed and operation proceeds directly to block 818. In this manner, the logic state of the BUT has been determined.

At block 818, it is queried whether the BUT is the last or least significant bit of $D_{TRIM}$, or bit T<0>. If not, operation proceeds to block 820 in which the next lower bit is selected as the next BUT, and SW6 is asserted to close the switch 315 to reset the error amplifier 102 for testing the next bit. Operation then loops back to block 810 in which the BUT is set to logic "1" and the remaining lower bits are set to half scale as though the BUT is the MSB. The previously determined higher significant bits remain unmodified, so that only the lower bits are adjusted for half scale using the new BUT as the most significant bit. Operation loops between blocks 810 and 820 for each bit, one by one, until the last bit T<0> is tested and set. Once the last bit T<0> is tested and set, operation transitions to block 822 in which CAL_STOP is asserted and the mode controller 136 switches operation back to the normal mode. Operation then loops back to block 804 to determine when to enter the calibration mode again during the normal mode. The calibration procedure is repeated on a synchronous manner (e.g., fixed time period) or asynchronous manner (e.g., one or more monitored parameters exceed threshold conditions).

The present description has been presented to enable one of ordinary skill in the art to make and use the present invention as provided within the context of particular applications and corresponding requirements. The present invention is not intended, however, to be limited to the particular embodiments shown and described herein, but is to be accorded the widest scope consistent with the principles and novel features herein disclosed. Many other versions and variations are possible and contemplated. Those skilled in the art should appreciate that they can readily use the disclosed conception and specific embodiments as a basis for designing or modifying other structures for providing the same purposes of the present invention without departing from the spirit and scope of the invention.

The invention claimed is:

1. A band gap circuit with offset voltage error correction, comprising:

a diode junction circuit comprising an input node, a first feedback node and a second feedback node, wherein said diode junction circuit comprises proportional and complimentary temperature coefficients when said first and second feedback nodes are driven to a common voltage level;

an error amplifier having a positive input coupled to said second feedback node, having a negative input coupled to said first feedback node, having an output, and having at least one trim node;

a current device having a control terminal coupled to said output of said error amplifier and having an output that provides a control current during a normal mode;

a bias current generator with constant gain that sinks a first bias current and that sources a second bias current;

a calibration circuit that monitors said output of said current device while adjusting a trim current provided to said at least one trim node of said error amplifier to minimize an offset voltage error of said error amplifier during a calibration mode; and a mode control circuit that couples said current device to said input node to provide said control current to said diode junction circuit during said normal mode, and that periodically enters said calibration mode during which said mode control circuit decouples said current device from said diode junction circuit, shorts together said positive and negative inputs of said error amplifier, and couples said current generator to sink said first bias current from said output of said current device and to source said second bias current to said input node of said diode junction circuit.

2. The band gap circuit of claim 1, wherein said mode control circuit comprises:

a first switch that couples said output of said current device to said input node of said diode junction circuit during said normal mode and that decouples said output of said current device from said diode junction circuit during said calibration mode;

a second switch that couples said output of said current device to said bias current generator to sink said first bias current during said calibration mode; and a third switch that couples said bias current generator to source said second bias current to said input node during said calibration mode.

3. The band gap circuit of claim 1, wherein said bias current generator comprises a current mirror circuit that is configured to develop said first and second bias currents to have nominal magnitudes that are equivalent to a nominal magnitude of said control current during said normal mode.

4. The band gap circuit of claim 1, wherein said diode junction circuit comprises:

a first resistor coupled between said input node and said first feedback node;

a first diode junction coupled between said first feedback node and ground;

a second resistor coupled between said input node and said second feedback node;

a third resistor having a first terminal coupled to said second feedback node and having a second terminal; and a second diode junction coupled between said second terminal of said third resistor and ground.

5. The band gap circuit of claim 4, wherein said bias current generator develops a reference current based on a gate-source voltage difference between a pair of MOS transistors divided by a first reference resistance and wherein said reference current is mirrored to develop said first and second bias currents, and wherein said diode junction circuit develops said control current proportional to a voltage difference between voltages developed across said first and second diode junctions divided by a resistance of said third resistor.

6. The band gap circuit of claim 1, wherein said calibration circuit comprises:

a trimming controller that monitors said output of said current device while updating a digital trim value during said calibration mode; and a trimming digital to analog converter (DAC) that converts said digital trim value to said trim current coupled to said at least one trim node of said error amplifier.

7. The band gap circuit of claim 6, wherein said trimming controller updates said digital trim value using successive approximation.

8. The band gap circuit of claim 6, wherein:

said error amplifier comprises:

a first set of transistors stacked between a source voltage and a common node including a first trim node and said positive input; and a second set of transistors stacked between said source voltage and said common node including a second trim node, said negative input and said output; and wherein said trimming DAC adjusts said trim current by balancing between a first trim current of said first trim node and a second trim current of said second trim node based on said digital trim value.

9. The band gap circuit of claim 8, wherein:

said first set of transistors comprises:

a first PMOS transistor having a source terminal coupled to a source voltage, having a gate terminal coupled to an upper node, and having a drain terminal; and a second PMOS transistor having a source terminal coupled to said drain terminal of said first PMOS transistor, having a gate terminal receiving an upper cascode voltage, and having a drain terminal coupled to said upper node;

wherein said second set of transistors comprises:

a third PMOS transistor having a source terminal coupled to said source voltage, having a gate terminal coupled to said upper node, and having a drain terminal; and a fourth PMOS transistor having a source terminal coupled to said drain terminal of said third PMOS transistor, having a gate terminal receiving said upper cascode voltage, and having a drain terminal coupled to said output of said error amplifier; and wherein said current device comprises a fifth PMOS transistor having a source terminal coupled to said source voltage, having a gate terminal coupled to said output of said error amplifier, and having a drain terminal comprising said output of said current device.

10. The band gap circuit of claim 9, wherein:

said error amplifier further comprises a switch having switched terminals coupled between said upper node and said output of said error amplifier, wherein said switch remains open during said normal mode; and wherein said trimming controller updates said digital trim value one bit at a time during said calibration mode, and for each bit being updated, momentarily closes said switch for a reset period to set said output of said error amplifier to a voltage level of said upper node.

11. The band gap circuit of claim 6, wherein said trimming DAC comprises:

an array of transistors each coupled to mirror a corresponding one of a plurality of scaled versions of a reference trim current;

a first array of switch pairs, each switch pair coupled to a corresponding one of said array of transistors and responsive to a corresponding one of a plurality of bits of said digital trim value for drawing said corresponding one of said plurality of scaled versions of said reference trim current from a selected one of said first and second trim nodes;

a first array of resistors coupled between said first trim node and a common node coupled to one of said array of transistors;

a second array of resistors coupled between said second trim node and said common node; and a second array of switch pairs, each switch pair comprising a first switch coupled to a corresponding one of said first array of resistors and comprising a second switch coupled to a corresponding one of said second array of resistors, and each pair responsive to a corresponding one of said plurality of bits of said digital trim value.

12. The band gap circuit of claim 11, wherein:

said array of transistors comprises successive transistors that are sized relative to each other having a scaling factor of less than two; and wherein said first array of resistors and said second array of resistors each comprise successive resistors that are sized relative to each other having a scaling factor of less than two.

13. The band gap circuit of claim 11, further comprising:

a sample capacitor coupled between a sample node and ground;

a sample switch coupled between a band gap voltage of said diode junction circuit and said sample node, wherein said sample switch is controlled by said mode controller which closes said sample switch during said normal mode and which opens said sample switch during said calibration mode;

a sample amplifier having a negative input coupled to said sample node, having a positive input and having an output;

a first PMOS transistor having a source terminal coupled to a source voltage, having a gate terminal coupled to said output of said sample amplifier, and having a drain terminal coupled to said negative input of said sample amplifier;

a low-temperature coefficient sample resistor coupled between said negative input of said sample amplifier and ground; and a second PMOS transistor having a source terminal coupled to said source voltage, having a gate terminal coupled to said output of said sample amplifier, and having a drain terminal providing said reference trim current.

14. A method of correcting offset voltage of a band gap circuit, wherein the band gap circuit comprises an error amplifier having a pair of inputs inputting a pair of feedback nodes of a diode junction circuit for driving a current device having an output that provides a control current to the diode junction circuit during a normal mode of operation, and wherein said method comprises:

periodically switching from the normal mode to a calibration mode by decoupling the output of the current device from the diode junction circuit, sinking a first bias current from the current device, sourcing a second bias current to the diode junction circuit, and shorting the inputs of the error amplifier; and trimming the error amplifier during the calibration mode, comprising:

adjusting at least one bit of a digital trim value comprising a plurality of bits, wherein said at least one bit includes a bit under test;

converting the digital trim value to a trim current applied to the error amplifier; and determining a state of the bit under test based on a state of the output of the current device.

15. The method of claim 14, wherein said trimming the error amplifier during the calibration mode comprises repeating said adjusting, converting, and determining for performing a successive approximation algorithm to determine each of the plurality of bits of the digital trim value.

16. The method of claim 14, wherein said trimming the error amplifier during the calibration mode comprises:

selecting a most significant bit of the digital trim value as the bit under test;

setting the bit under test high and setting remaining lower bits to half scale;

determining a final state of the bit under test for a current session of the calibration mode based on a state of the output of the current device;

selecting the next lower significant bit as the bit under test; and repeating said setting the bit under test high, said determining a final state of the bit under test, and said selecting the next lower significant bit as the bit under test for each remaining bit of the digital trim value.

17. The method of claim 16, further comprising resetting the error amplifier to mid-rail before each of said determining a final state of the bit under test.

18. The method of claim 14, wherein said sinking a first bias current from the current device comprises sinking a first bias current having a magnitude that is equivalent to a nominal magnitude of the control current during the normal mode, and wherein said sourcing a second bias current to the diode junction circuit comprises sourcing a second bias current to the diode junction circuit having a magnitude that is equivalent to a nominal magnitude of the control current during the normal mode.

19. The method of claim 14, wherein said converting the digital trim value to a trim current applied to the error amplifier comprises adjusting a balance between a first trim current applied to a first trim node of the error amplifier and a second trim current applied to a second trim node of the error amplifier.

20. The method of claim 19, further comprising:

developing, by the diode junction circuit, a band gap voltage during the normal mode;

sampling the band gap voltage during the normal mode and holding a sample of the band gap voltage on a sample node during the calibration mode; and converting the band gap voltage on the sample node to a reference trim current used to develop the first and second trim currents.

* * * * *